United States Patent [19]

Hamer

[11] 4,054,282

[45] Oct. 18, 1977

[54] AUXILIARY OPERATING TABLE FOR HAND SURGERY AND THE LIKE

[75] Inventor: Merlin L. Hamer, La Jolla, Calif.

[73] Assignees: Louis O. Scheu, Jr.; Alvin C. Kniss; Kleinert, Kutz & Lister, all of Louisville, Ky. ; part interest to each

[21] Appl. No.: 743,140

[22] Filed: Nov. 19, 1976

[51] Int. Cl.[2] ..... A61G 13/00

[52] U.S. Cl. ..... 269/328

[58] Field of Search ..... 269/328, 322; 5/92

[56] References Cited

U.S. PATENT DOCUMENTS 2,871,074 1/1959 Malerich ..... 269/328

FOREIGN PATENT DOCUMENTS 482,548 3/1953 Italy ..... 269/328

*Primary Examiner*—Robert C. Watson
*Attorney, Agent, or Firm*—Arthur F. Robert

[57] ABSTRACT

An auxiliary operating table, which functions primarily to support a patient's arm horizontally outstretched at a 90° angle to the side rail frame of a body table on which the patient is supported during arm or hand surgery. The auxiliary table, which is collapsible, has a rigid table top with outer and inner ends. Its outer end carries a foldable gas spring leg, which is pivoted for movement between table supporting and table collapsed positions, which tends to extend automatically to its full length, which can be forcibly retracted, and which has a foot-pedal-operated leg clamp for holding the table leg in any table-supporting position within its extension-retraction range. Its inner end carries a depending clamping assembly for securing the auxiliary table to and supporting it on the body table. The inner end clamping assembly includes: a rail clamp and an adjustable table clamp. The rail clamp is rigidly securable to the rail. The adjustable table clamp connects the auxiliary table to the rail clamp. When the table clamp is released, it not only permits the inner body table end of the auxiliary table to be raised or lowered relative to the body table but it also permits the auxiliary table as a whole to be turned angularly relative to the body table. Likewise, when the foot pedal is operated to release the leg clamp, a surgeon can adjust the elevation of the outer end of the auxiliary table without hand contamination either by allowing the gas leg to expand automatically and thereby raise the table's outer leg end to a desired position or by pressing his elbows downwardly against the top of the table to contract the gas leg and thereby lower the outer leg end of the table to a desired position. In either event, when the foot pedal is released, the leg is clamped in its contemporaneous position.

8 Claims, 9 Drawing Figures

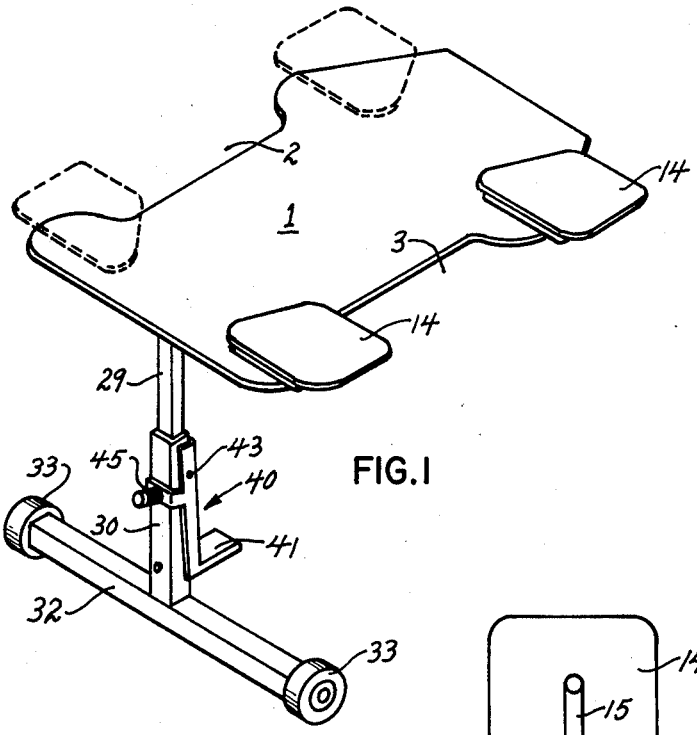
FIG.1
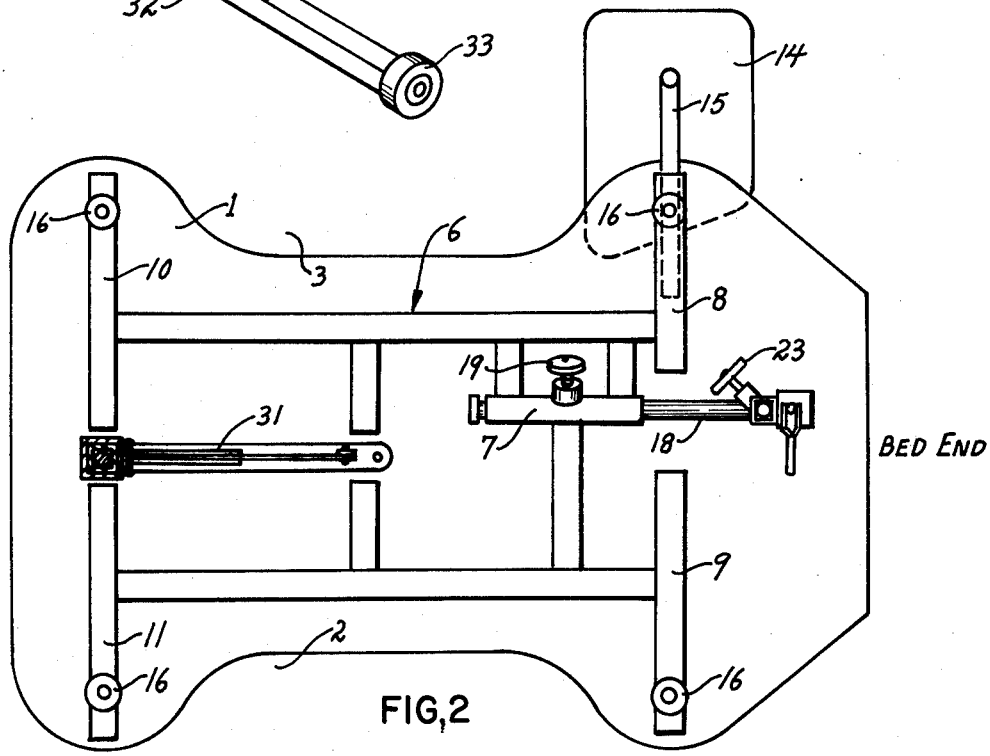
FIG,2

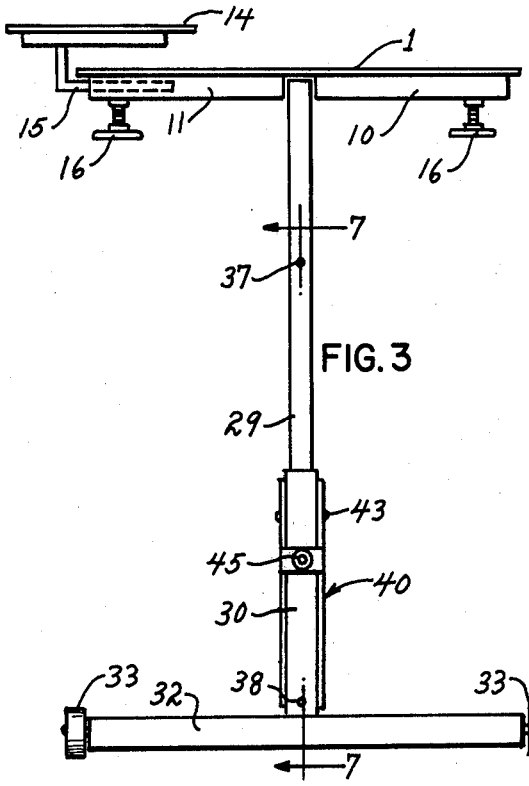
FIG. 3
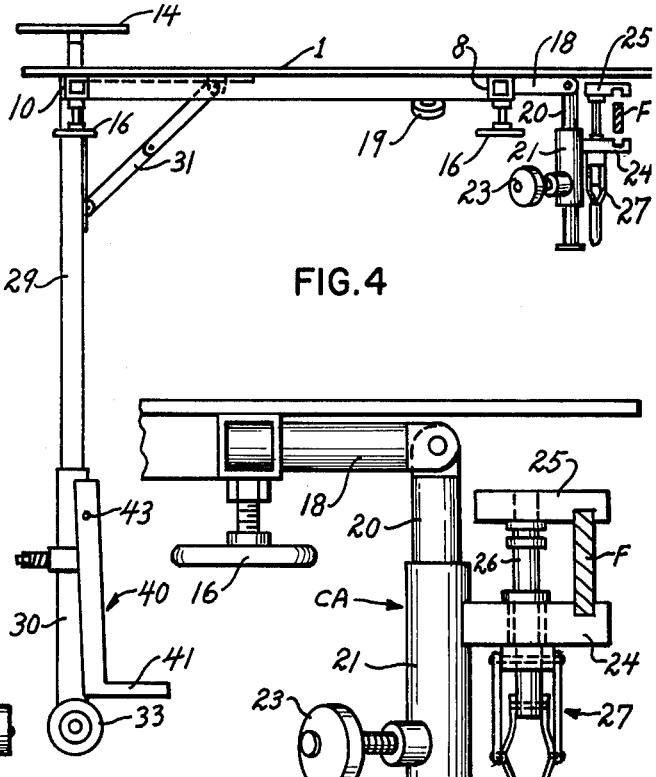
FIG. 4
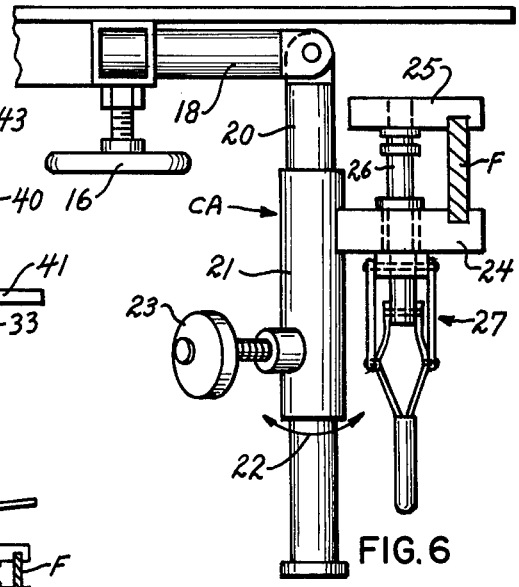
FIG. 6
FIG. 5
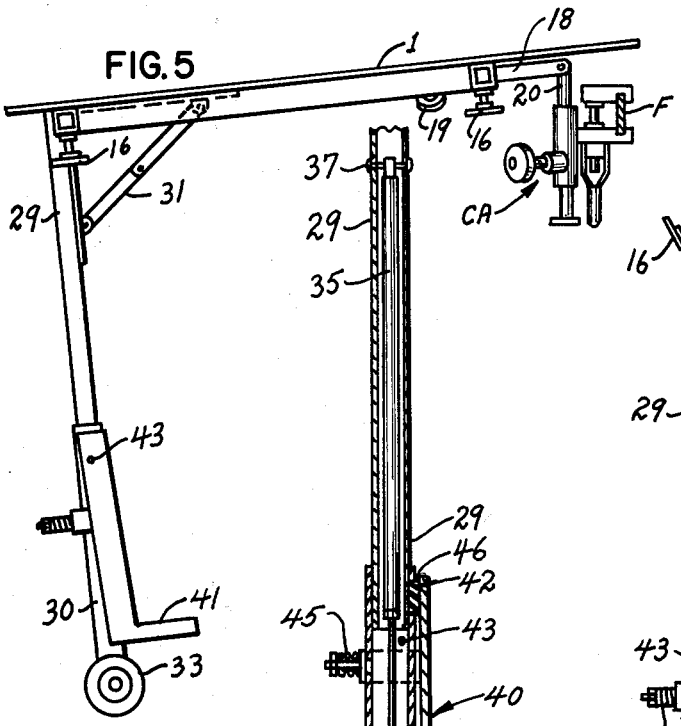
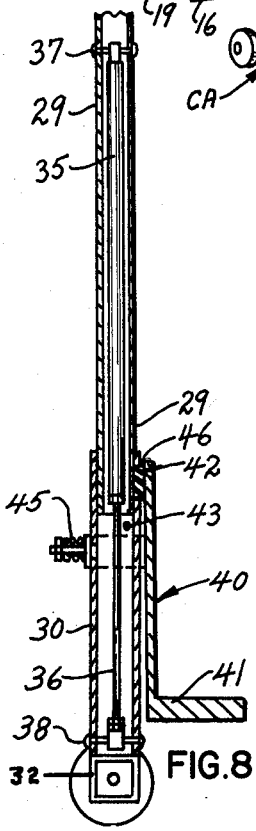
FIG. 8
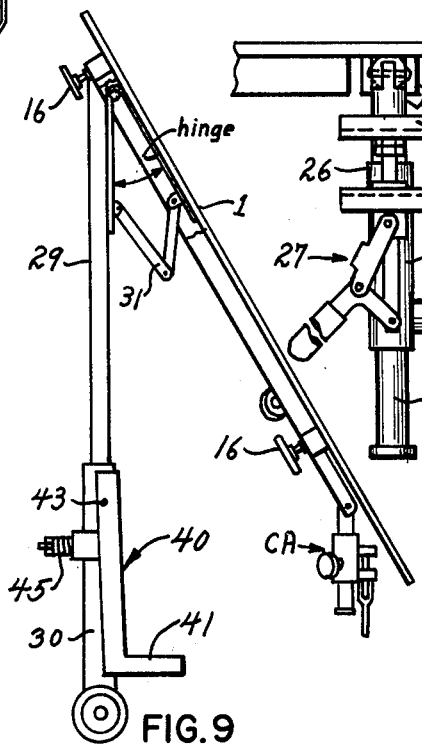
FIG. 9
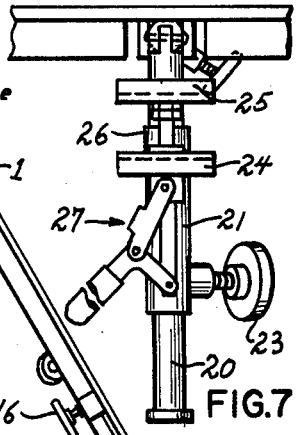
FIG. 7

AUXILIARY OPERATING TABLE FOR HAND SURGERY AND THE LIKE

BACKGROUND OF THE INVENTION

1. Field Of The Invention

This invention relates to the operating table art and more particularly to auxiliary operating tables for use in hand and like surgery.

2. Description Of The Prior Art

The Alderman et al. U.S. Pat. No. 1,208,885 dated Dec. 19, 1916 shows an auxiliary operating table top having rail clamping means at its inner bed end and adjustable leg support means at its outer leg end. This patent does not show a depending clamping assembly at its inner bed end or the gas spring leg at its outer end. The Krewson U.S. Pat. No. 2,605,152 dated July 29, 1952 shows an armrest attachment for a surgical table wherein a horizontal armrest support is securely clamped at one end to a surgical table with its opposite end projecting outwardly and being otherwise unsupported. The Parker U.S. Pat. No. 2,609,261 dated Sept. 2, 1952 shows an auxiliary table having an inner or bed end slidably inserted underneath the patient on the body table and an outer end supported by a depending leg. The Douglass Jr. et al. U.S. Pat. No. 3,046,072 dated July 24, 1962 discloses: an auxiliary table top called a board; a bed rail attachment having a somewhat complicated bracket clampable to the bed rail of a body table in any of a range of selected positions along the rail; and means mounting the board upon the bracket for vertical and horizontal adjustment of the board relative to the bracket. The board mounting means includes: a vertical first rod arranged on the bracket for vertical or horizontal angular adjustment to place its upper end at a desired elevation in a desired angular position; a horizontal second rod rigidly secured to extend from the upper end of the first rod; means mounting the board horizontally on the free end of the second rod for horizontal angular movement relative thereto; and means for clamping the board to the second rod in the desired position.

SUMMARY OF THE INVENTION

Objects of the Invention

The principal object of the present invention is to provide an auxiliary operating table which is relatively simple in design, inexpensive to construct and so sturdy, when constructed, as to permit its use during microsurgery where the slightest movement of the surgeon's arm support may prevent him from keeping his vision clearly fixed upon the tiny area on which he may be operating.

Another object is to provide a collapsible lightweight auxiliary table which a nurse may readily carry from storage to a body table, easily and quickly secure it to the body table and otherwise set it up in a position closely approximating the starting position which the surgeons may desire.

A further object is to provide an auxiliary table which, before or during surgery, may be readily adjusted in elevation without hand contamination.

A further object is to provide an auxiliary table which is separate and apart from and out of direct or indirect contact with the body of a patient lying on the body table so that the auxiliary table will not create any discomfort for the patient and will permit some readjustment of the patient's body by the anesthesiologist during surgery without interfering with the surgical process.

Another object is to provide an auxiliary table with adjustable platforms which can be used by a surgeon as an aid in stabilizing the position of his arms and hands during microsurgery and as a support for readily available surgical instruments.

STATEMENT OF THE INVENTION

Most if not all of the important objects of my invention are achieved in an auxiliary table to support a patient's arm horizontally outstretched at an angle to the side rail of the frame of a body table on which the patient is supported during arm or hand surgery, comprising: a table top having inner and outer bed and leg ends and opposite side margins along which surgeons may be seated; means for rendering the table top sufficiently rigid an sturdy as to be substantially vibrationless and unyielding; elevated platforms at one or more locations over the table top; means for securing the inner or bed end of the top to, and supporting it on, the side rail of a body table; extensible-retractable leg means for supporting the outer or leg end of the top on the floor, said leg means automatically tending yieldably to extend itself; and a leg clamping assembly for holding the leg means in a given table supporting position within its extension-retraction range.

In the process of setting the table up, its inner or bed end is secured to the rail and adjusted vertically to the desired elevation. The table top as a whole may also be swung horizontally, if necessary, to provide a desired angle, say 90°, between the body table and the table top. The leg means, which normally are folded inwardly along the underside of the table top, are arranged to extend vertically. With an automatically extensible gas leg in a vertical position, the foot pedal is operated to unclamp the leg and the leg is then either allowed to expand sufficiently to place the outer end of the table at the desired level or forcibly retracted to that level whereupon the pedal is released to clamp the table top at that level. The top will normally be level. Since it may be desirable at some time to incline it, the leg is provided with floor-engaging rollers to facilitate their accommodating movement.

BRIEF DESCRIPTION OF THE DRAWINGS

The preferred embodiment of the present invention is illustrated in the accompanying drawings wherein:

FIG. 1 is a perspective view of the table having a leg end at the left and a bed end at the right, this view looking at the left leg end;

FIG. 2 is a bottom plan view as seen in FIG. 1, this view omitting all, except one, of the elevated "elbow" supports seen at the corners of FIG. 1;

FIG. 3 is an elevational view of the leg end of the table, only one "elbow" support being shown;

FIG. 4 is a side elevational view of the unclamped table of FIG. 3 with its leg end at the left;

FIG. 5 corresponds to FIG. 4 but shows the table top inclined;

FIG. 6 is an enlarged fragmentary side elevational view of the bed end clamping means as seen in FIG. 4;

FIG. 7 is a front end elevational view of the bed end clamping mechanism as seen in FIG. 5;

FIG. 8 is a sectional view of the leg structure taken through line 7—7 of FIG. 3; and FIG. 9 is a side elevational view of the table with the top folded downwardly partly toward the leg.

DESCRIPTION OF THE PREFERRED EMBODIMENT

The auxiliary operating table generally comprises: a table top; top-reinforcing means; elevated platforms; means for supporting the table top including a bed end support means and an opposite leg end support means; and a leg clamping assembly.

Table Top

The table top 1 is of suitable length, width and thickness. It may be composed of any suitable sheet material preferably having a smooth polished top surface which can readily be kept in a septic condition. It should be of lightweight yet sufficiently rigid to resist flexing under the normal (mostly downward) pressures to which it may be subjected during use. Tops composed of aluminum or stainless steel sheet of suitable thickness are recommended. The opposite side edges of the top 1 have their mid-portions indented at 2 and 3 to accommodate the surgeons. The operating table top has bed and leg or front and rear ends. In use, the front bed end is adjacent the body table on which the patient is supported during surgery.

The rigidity of the table top should be such as to render it vibrationless and unyielding in use. This is best accomplished by providing it with reinforcing means.

Top Reinforcing Means

A rigidly integrated reinforcing metal structure 6 is welded or otherwise firmly secured to the underside of the top 1. The structure 6 is largely composed of rigid hollow tubular metal members, preferably rectangular in cross-section, and arranged to bear flatly against the underside of the table top to which they are suitably secured, preferably by welding. The structure 6 is fashioned to provide certain members with outwardly open ends through which other snugly fitting members may be telescopically received. As seen in FIG. 2, these outwardly open members of reinforcing structure 6 include: a longitudinally-extending "middle" member 7 centrally disposed in the rear part of the front half of the bed end of the operating table, toward which its front end opens; a pair of oppositely disposed laterially-extending side members 8, 9 located on the underside of the inner or front end portion of the table top to open endwise outwardly along opposite sides of the table; and a corresponding pair of outwardly open, oppositely disposed, laterally extending members 10 and 11 on the outer or rear leg end portion.

Elevated Platforms

The top 1 of the operating table carries, near each corner, an elevated platform 14 mounted on the integrated reinforcing structure 6 through an interposed integral L-shaped support 15 (see FIGS. 2, 3) having a vertical leg rigidly fixed to the underside of the platform 14 and a horizontal leg telescopically mounted within the adjacent one of the four side tubular members 8, 9, 10 and 11 of the reinforcing structure 6 for horizontal adjustment within a range of horizontally projecting positions. Each platform is held in its adjusted position by a clamping screw 16.

Inner or Bed End Support of Table Top

At the inner, front or bed end of the operating table and its table top 1, the table integrated reinforcing structure 6 carries a mechanism which is securable to a side frame F (see FIGS. 4, 5 and 6) of the bed table for supporting the bed end of the operating table upon a frame F. This mechanism includes: a horizontal support 18 slidably mounted within tubular middle member 7, of the table reinforcing structure 6, for horizontal linear adjustment within a limited range of forwardly projecting positions and held in its adjusted linear position by clamp screw 19; a vertical support 20 pivotally secured to depend from the front end of the horizontal support 18; and a clamping assembly adjustably carried by the vertical support 20. The clamping assembly includes: a sleeve 21 slidably mounted on the depending vertical support 20 for vertical adjustment within a limited range of positions and, as indicated by arrow 22 in FIG. 6, for limited right and left angular adjustments about the axis of the vertical support 20, the sleeve 21 being held in its adjusted position (vertical and angular) by a clamping screw 23; a fixed horizontal bracket or jaw 24 projecting forwardly from and rigidly connected to sleeve 21; a movable horizontal jaw 25 rigidly carried by a vertical stem 26 which passes downwardly through and projects below fixed jaw 24; and a toggle 27 interconnecting the lower projecting part of stem 26 and fixed jaw 24 and operative, when actuated down and up, to move the movable jaw 25 downwardly toward and upwardly away from the fixed jaw 24 for clamping and unclamping purposes.

Leg End Support of Table Top

The outer, rear or leg end support for the operating table includes a vertically arranged telescopic leg assembly primarily comprising: an outer telescopic housing; and an inner extensible-retractable "telescopic" gas spring, which tends automatically to extend itself and the housing.

The outer telescopic housing (see FIG. 7) includes: a telescopic housing 29, 30 composed of an upper housing part 29 and a lower housing part 30 which snugly and telescopically receives the upper part 29; hinge means pivotally securing the upper end of the upper housing part 29 to the centrally disposed leg end portion of the table top 1 for movement from a vertical position forwardly and upwardly to a folded position adjacent the underside of the table top; a toggle 31 interconnecting the upper housing part 29 with the underside of the table top 1 for firmly holding the leg in its vertical position while permitting its movement to a folded position; and means for supporting the lower end of the telescopic leg assembly upon the floor. This lower end support comprises: a cross frame 32 rigidly secured to the lower end of the lower outer housing part 30; and a pair of floor-engaging wheels 33, one at each of the opposite ends of the cross frame.

The inner gas spring 35, 36 comprises: an upper gas cylinder 35 containing a piston or piston head (not shown); and a lower piston rod 36 which extends from the piston head downwardly through the lower end of the cylinder and projects downwardly therefrom. The gas cylinder 35 has its uppermost end firmly connected at 37 to the upper housing part 29 and the piston rod 36 has its lowermost end firmly connected at 38 to the outer housing part 30. With this arrangement, it will be appreciated that the extension and retraction of the housing is effected by the extension and retraction of the gas spring.

Before continuing, it may be noted that the "gas spring" shown and preferred, is a device presently manufactured and sold by The Gas Spring Corporation, 17

Commerce Drive, Montgomeryville, Pa. 18936. Its cylinder 35 is hermetically closed despite the fact that the piston rod 36 projects slidably therefrom. The cylinder is factory-loaded with an inert gas at a given pressure of, say, 25 lbs. The piston is provided with an orifice allowing gas to transfer from one side to the other. Since the load or piston-rod side of the piston head has a smaller area than the top side thereof, the gas pressure tends to extend the cylinder 35 outwardly upward at a rate slow enough to permit an operator to stop the action at a desired degree of extension. A small quantity of oil normally passes through the orifice at the end of the stroke and, in so doing, achieves a damping or "shock absorber" effect. The outward force generated is continuous and linear and can be varied in units from about 20 to 250 pounds. Strokes up to 15" are available. The gas spring, when fully extended, preferably inclines the table top 1 from its leg end to its bed end, as seen in FIG. 8.

Leg Clamping Assembly

To hold the gas spring in any partially extended position, the housing or the gas spring must be clamped. To this end, a leg clamping assembly is provided comprising: a vertically arranged L-shaped member 40 providing a horizontally projecting foot pedal 41 at its lower end and carrying a clamping pad 42 on the inner side of the upper end of its leg member (see FIG. 7); pivot means 43 located on the leg member below the pad 42 to secure the upper end of the leg member of 40 to the upper end of lower housing part 30; and a spring 45 normally biasing member 40 to force its pad 42 through an adjacent opening or window 46 in housing part 30 into firm engagement with the adjacent portion of upper housing part 29. With the housing parts thus held in a given position, the gas spring is similarly held in a corresponding position out of which it cannot extend or retract until the clamp pad or brake 42 is operated to release the housing parts.

Preparing For Use

In preparing for use, the lightweight folded operating table can be carried by a nurse to the bed table, unfolded, placed at a right angle to the bed table with its front or bed end adjacent the bed table and with its clamping jaws 24–25 operatively positioned under and over side frame F as seen in FIG. 4. Now the clamping assembly is raised along stem 20 until lower jaw 24 engages side frame F, and then operating the toggle 27 to clamp the upper jaw 25 downwardly against frame F. If, when this is done, the table top 1 inclines toward the bed end, as seen in FIG. 8, it simply means that the leg is clamped in a partially extended position; hence, the clamping brake pad 42 is released by stepping on foot pedal 41 which allows the gas spring to extend slowly. The clamp is re-applied when the leg is extended enough to raise top 1 to the level position. During this movement, the lower end of the leg will roll on wheels 33 from the inclined leg position shown in FIG. 8 to the 90° vertical position shown in FIG. 4.

Usually the top 1 and the raised elbow supports 14 are covered by sterile cloth. The patient on the body table usually lies in a supine position with that arm, which is adjacent to the rail frame F of the body table, extending over and resting on the auxiliary table top. The surgeons are seated at recesses 2 and 3 facing each other.

Features

The auxiliary operating table has a number of features.

For example, the auxiliary operating table can be clamped securely to the rail of most standard patient-supporting body tables and rigid securement is desirable since it eliminates any unwanted motion at the connection. Also, the present operating table provides no hard edge under a patient or under the mattress upon which the patient may lie. A hard edge often becomes uncomfortable to the patient within as little as 30 minutes even through separated from the patient by a mattress.

The surgeon can adjust the height of the clamped auxiliary operating table at its outer leg end prior to or during operative procedures without fear of hand contamination. Thus the top can be raised simply by operating the foot pedal to release the brake and permit the gas spring to extend automatically. The top can also be lowered by the surgeon simply by contemporaneously releasing the brake and pressing his elbows downwardly against the table top with sufficient force to effect downward movement against the upward extension force of the gas spring.

The inner, front or bed end of the auxiliary operating table can be adjusted in height for top leveling or sloping purposes by raising or lowering stem 20 relative to sleeve 21 over a reasonable range to accommodate differences between the horizontal top levels of different patient-supporting body tables, such as exists between those having a pad or mattress and those not having one. Also this adjustment permits the use of a Bucky frame which provides a 2 to 3 inch space directly under the patient for holding an X-ray film cassette. Before or during the operation, the auxiliary operating table can also be adjusted angularly about stem 20, as indicated by arrow 22.

The auxiliary operating table can be adjusted along member 7 inwardly toward or outwardly away from the mid-line of the body table which enables the hand of short and tall patients to be placed in the optimal position on the auxiliary operating table. Furthermore, this adjustment can be carried out while still maintaining the operating table securely clamped to the body table.

The anesthesiologist can manipulate the patient, if he finds it necessary, without affecting the table top. This cannot be done where the auxiliary table top extends over the side frame F of the patient-supporting body table and underneath the patient.

The floor-engaging wheels 33 of the extensible leg allow the lower end thereof to swing smoothly in and out as the inner end of the table is raised or lowered and to move smoothly over the floor without swinging when the auxiliary operating table is moved inwardly or outwardly along member 7.

The elevated supports 14, at each corner of the operating table, can be used to aid in stabilizing the position of the surgeon's arms and hands during microsurgery. They can also be used to support surgical instruments in readily available positions.

The table is relatively simple in design and inexpensively yet sturdily constructed. Its sturdiness is of such order that it may be used during microsurgery where the slightest movement of the table top or surgeon's arm support interfers with the surgeon's ability to keep his vision fixed upon an extremely small operating area. Its light weight makes it convenient for the nurses not only to carry it but also to attach it to and detach it from the bed table.

For the sake of clarity, it should be understood that references herein to "body" or "bed" table are intended to designate the standard operating table or whatever table is used in its place.

Having described my invention, I claim:

1. An auxiliary operating table for supporting a patient's upper extremity normally at about 90° to the side rail of the frame of a body table on which the patient is supported during upper extremity surgery, comprising:

A. an auxiliary operating table top having an inner or front bed end, an outer or rear leg end and opposite side margins along each of which a surgeon may be seated;

B. rail clamping means carried from the bed end portion of said table top and securable to said side rail of a patient-supporting body table for supporting the inner end of the auxiliary table upon the frame of said body table; and C. adjustable floor-engaging table-supporting leg means, under the control of a seated surgeon, for enabling the outer end of said table top to be adjusted to and supported at any selected level within a limited vertical range without subjecting the surgeon to hand contamination, 1. said leg means including a vertical leg secured at its upper end to said table top, a. said vertical leg including an extensible-retractable telescopic gas spring of a type which automatically tends to extend the leg and thereby raise said outer end and which may be retracted by a seated surgeon exerting on the table top downwardly directed elbow pressure sufficient to lower said outer end.

2. The table of claim 1 wherein:

A. said rail clamping means includes 1. a horizontal support slidably mounted on the table top to extend along the underside of the bed end portion thereof, and 2. a vertical support having a vertical axis and being pivoted to said horizontal support to depend therefrom about its vertical axis; and B. said rail clamping means is operative, when secured to the side rail of a body table, to support the bed end portion of the table 1. for horizontal angular adjustment about said vertical center axis to permit the auxiliary operating table to be turned angularly relative to said body table, 2. for horizontal linear adjustment through said slidable horizontal support, to permit the bed end portion of the auxiliary table to be moved away from and toward said body table to accommodate variations in the length of the upper extremities of different patients on said body table, and 3. for vertical linear adjustment along said vertical support to raise and lower the bed end portion of the table.

3. The table of claim 2 wherein:

A. the outer end of the table top and the upper end of said vertical leg pivot about the pivot securing said horizontal and vertical supports together when the outer end of said table top is raised by the extension of said leg.

4. The table of claim 1 wherein:

A. said rail clamping means includes means for adjusting the inner end of the table top vertically in relation to said side rail;

B. during use, the vertical leg means and the table top cooperate to form a fixed angle so that, when the inner end of the table top is vertically adjusted in elevation, the lower end of the leg means correspondingly moves horizontally; and C. means supporting the lower end of the leg means on wheels to facilitate said corresponding horizontal movement.

5. The table of claim 1 including:

A. elevated supports mounted on the operating table for adjustment to positions affording convenient engagement by a surgeon in stabilizing the position of one or both of his upper extremities during surgery.

6. The table of claim 1 wherein said vertical leg means comprises:

A. an outer telescopic housing assembly; and

B. means connecting corresponding telescopic parts of the housing assembly and gas spring together for contemporaneous extension and retraction purposes.

7. The table of claim 6 including:

A. means for releasably holding said telescopic housing assembly and gas spring in an adjusted position.

8. The table of claim 7 including:

A. foot pedal operated means for releasing said telescopic housing assembly holding means.

* * * * *

UNITED STATES PATENT OFFICE

CERTIFICATE OF CORRECTION

Patent No. 4,054,282 Dated Oct. 18, 1977

Inventor(s) Merlin L. Hamer

It is certified that error appears in the above-identified patent and that said Letters Patent are hereby corrected as shown below:

In that page of the patent which names the assignees, after "Kniss;" insert -- Merlin L. Hamer; --

Signed and Sealed this

*Seventh* Day of *February 1978*

[SEAL]

*Attest:*

RUTH C. MASON
*Attesting Officer*

LUTRELLE F. PARKER
*Acting Commissioner of Patents and Trademarks*